US005725205A

United States Patent [19]

O'Berg

[11] Patent Number: 5,725,205

[45] Date of Patent: Mar. 10, 1998

[54] DOOR ASSEMBLY APPARATUS HAVING LIFT FRAME AND TRANSLATABLE AND ROTATABLE COMPONENT CAPTURE UNITS

[75] Inventor: Carl O'Berg, Melbourne, Fla.

[73] Assignee: Braid Sales and Marketing, Inc., Melbourne, Fla.

[21] Appl. No.: 611,643

[22] Filed: May 14, 1996

[51] Int. Cl.[6] ..... B25B 1/20

[52] U.S. Cl. ..... 269/37; 269/43; 269/905; 269/71; 269/289 R

[58] Field of Search ..... 269/43, 71, 905, 269/13, 289, 910, 289 MR; 29/281.5

[56] References Cited

U.S. PATENT DOCUMENTS

| | | | |
|---|---|---|---|
| 1,388,408 | 8/1921 | Crosbie | 269/43 |
| 2,188,053 | 1/1940 | Madsen | 269/37 |
| 2,825,477 | 3/1958 | Ross | 269/37 |
| 3,458,056 | 7/1969 | Stefan et al. | 269/905 |
| 3,625,504 | 12/1971 | Walker | 269/905 |
| 3,899,164 | 8/1975 | Newman | 269/71 |
| 4,500,235 | 2/1985 | Johnsen | 269/43 |
| 4,723,769 | 2/1988 | Nilsson | 269/71 |
| 4,729,552 | 3/1988 | Pempek | 269/71 |
| 4,998,336 | 3/1991 | Papsdorf | 269/910 |

*Primary Examiner*—Timothy V. Eley
*Assistant Examiner*—Lee Wilson
*Attorney, Agent, or Firm*—Charles E. Wands

[57] ABSTRACT

A door assembly apparatus comprises a table having a top frame and a controllably driven lift frame supported immediately beneath the top frame to support a first door component, such as an insert, adjacent to the top frame for insertion into an associated opening in the main body of the door that has been placed upon the top frame and is captured by a workpiece member capture and manipulation unit. The workpiece grasping and manipulation unit is mounted adjacent to opposite ends of the table to grasp and manipulate the orientation of the main body relative to the door insert, to join the door components together into an assembled door. To facilitate removal of the assembled door from the table, a controllably tiltable frame is arranged to receive the assembled door from the top frame and controllably tilt the assembled door away from the top frame. The workpiece grasping and manipulation unit comprises first and second rack and pinion driven elevator mechanisms, which controllably elevate the main body of the door member above the door insert as retained by the lift frame, and provide for rotation of the elevated main body of the door. The workpiece grasping and manipulation unit includes a pinion drive unit having a drive shaft that is coupled to the pinions of each rack and pinion elevator mechanism.

16 Claims, 5 Drawing Sheets

DOOR ASSEMBLY APPARATUS HAVING LIFT FRAME AND TRANSLATABLE AND ROTATABLE COMPONENT CAPTURE UNITS

FIELD OF THE INVENTION

The present invention relates in general to multiple workpiece assembly machines, and is particularly directed to a new and improved door assembly apparatus, which is operative to securely capture and manipulate the components of a (pre-hung) door, through successive orientations (including translation and rotation) that facilitate door assembly, regardless of the size and type of door employed.

BACKGROUND OF THE INVENTION

Because of the wide variety of sizes and materials employed in the construction of residential, commercial, architectural, industrial and fire-containment doors, door manufacturers have had to resign themselves to either employing a large number of different, customized door-assembly machines, or using a lesser number of assembly tables which can be retro-fitted to accommodate different types of doors. An obvious drawback to the first approach is the fact that the door manufacturing plant must have a very large amount of floor space to accommodate the various pieces of equipment required; however, even with such a capability, the cost per door is directly impacted, since each assembly table will not always be operating at full capacity. On the other hand, where floor space can be reduced by using door assembly tables that can be reconfigured to handle different sizes and types of doors, there still remains the penalty of the down time required to adjust the parameters of the table whenever a changeover is to be made.

SUMMARY OF THE INVENTION

In accordance with the present invention, the drawbacks of such conventional door manufacturing schemes are effectively obviated by means of a new and improved multiple workpiece (e.g., pre-hung door) assembly apparatus which comprises a table having a top frame and an associated support structure for supporting the top frame above a base support region (e.g., floor) upon which the table is placed. A controllably driven lift frame is supported by the table immediately beneath the top frame and is configured to support a first workpiece, such as a door insert, adjacent to the top frame for insertion into an associated opening in the main body of the door. The lift frame position control mechanism may comprise a scissors-configured lift mechanism.

A second workpiece capture or grasping unit is mounted adjacent opposite ends of the table and is operative to capture or grasp a second workpiece member (e.g., the main body of the door and an associated frame) that has been placed upon the top frame. The second workpiece capture unit provides for manipulation of the orientation of the second workpiece relative to the first workpiece member as supported by the underlying lift frame, so as to facilitate joining the first and second workpieces together into an assembled workpiece, while the two are respectively retained by the lift frame and the second workpiece capture unit. To facilitate removal of the assembled workpiece from the table, an assembled workpiece release unit, configured as a controllably tiltable frame, is supported by the table and is arranged to receive the assembled workpiece from the top frame and controllably tilt the assembled workpiece away from the top frame. For this purpose, the top frame includes first and second side rails upon which respective sets of roller elements are mounted to facilitate translation of the second workpiece to a set of roller elements installed on the tilt frame.

In accordance with a preferred embodiment of the invention, the second workpiece capture unit comprises first and second workpiece capture mechanisms which are configured to engage the second workpiece adjacent to first and second respective locations of the top frame. Each of the first and second workpiece capture mechanisms is operated by a respective pinion-driven rack, mounted to a column of each workpiece capture mechanism. The output shaft of a pinion drive unit imparts controlled rotational drive to a pinion of each workpiece, so as to elevate the second workpiece above the first workpiece supported by the lift free, and to provide for rotation of the second workpiece in its raised position above the top frame.

DETAILED DESCRIPTION

Figure 1:
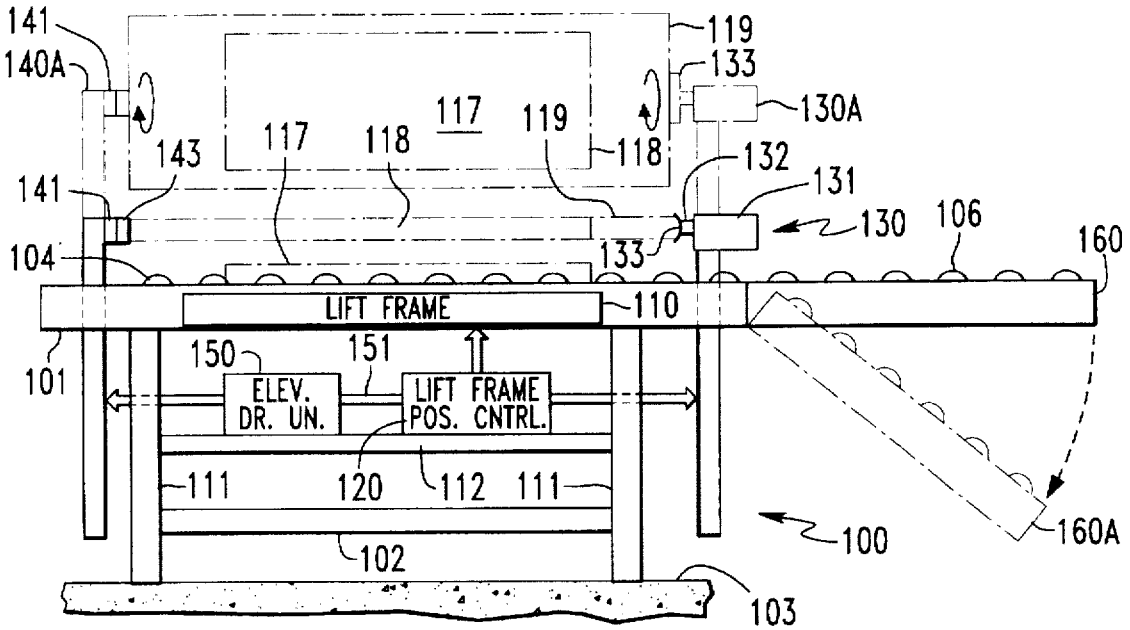
FIG. 1 is a diagrammatic side view of the workpiece/door assembly apparatus in accordance with an embodiment of the present invention.

Referring now to FIG. 1, the workpiece/door assembly apparatus in accordance with the present invention is diagrammatically illustrated as comprising a table 100, formed of a suitable industrial strength material such as steel, and having a generally horizontal, longitudinally extending rectangular-shaped top frame 101 and a generally horizontal, rectangular-shaped lower frame 102, each of which is affixed to and thereby supported above a floor region 103 upon which the table is placed, by way of a plurality of (four) vertical legs 111. The top frame 101, lower frame 102, and legs 111 of the table effectively form a sturdy box-like structure by way of which the door capture and manipulation components of the door assembly apparatus of the present invention are supported.

A controllably driven lift frame 110 is supported by a lift frame position control mechanism 120 mounted to a support platform 112 beneath the top frame 101 and is configured to support a first workpiece, such as a door insert, diagrammatically shown in broken lines 117. As will be described below with reference to FIG. 7, the lift frame position control mechanism 120 may comprise a scissors-configured lift mechanism, and is operative to controllably vertically translate the lift frame 110, so that a workpiece, such the door insert 117, may be initially positioned immediately beneath and adjacent to the top frame 101 for insertion into an associated opening 118 in the main body of a door shown in broken lines 119, that is initially placed upon respective sets of rollers 104 installed along rails of the top frame 101, and thereafter captured and retained by a capture and manipulation unit.

The workpiece member capture (or grasping) and manipulation unit is comprised of a pair of elevator and rotation units 130 and 140 mounted adjacent to opposite ends of the table 100, and an associated drive unit 150 mounted to support platform 112. Drive unit 150 has an output shaft 151 that is coupled to pinion drives of units 13 and 140. When drive unit 150 drives output shaft 151, it controllably operates units 130 and 140 so that a second workpiece member (e.g., the main door body 118) that has been placed upon the rollers 104 of the top frame, may be seized and manipulated for assembly with the first workpiece carried by lift frame 110.

To facilitate removal of the assembled workpiece from the table 100, an assembled workpiece release unit, configured as a controllably tiltable frame 160 having respective sets of rollers 106 mounted upon its side rails, is supported adjacent to the elevator and rotation unit 130, and is arranged to receive the assembled workpiece from the top frame 101 and to controllably tilt the assembled workpiece away from the top frame, as shown by broken lines 160A.

In accordance with a preferred embodiment of the invention, the elevator and rotation units 130 and 140 are configured as rack and pinion driven elevator mechanisms, described in detail below with reference to FIGS. 8–11, and which are controllably driven so as to initially capture the second workpiece that has been placed upon the rollers 104 of the top frame 101, and then controllably elevate the second workpiece above the table, as shown by broken lines 130A and 140A, so as to facilitate manipulation of the captured workpiece. The drive unit 150 for the elevator and rotation units 130 and 140 has a longitudinal output drive shaft 151, which is supported by bearing mounts along the length of the table so that it may be coupled to the pinions of each the first and second rack and pinion driven elevator and rotation units 130 and 140.

The elevator and rotation unit 130 includes a clamping unit 131 having an axially driven, rotatable output shaft 132 to which a workpiece clamping or grip element 133 is affixed. Similarly, elevator and rotation unit 140 includes a rotational follower unit 141 having a rotatable shaft 142 to which a workpiece gripping or clamping pad element 143 is mounted. In order to seize a workpiece that has been placed upon the rollers 104 of top frame 101, the workpiece is translated along rollers 104 unit one end of the workpiece abuts against clamping pad element 143 of elevator and rotation unit 140. Unit 130 is then operated to axially translate output shaft 132, as necessary, such that clamping element 133 engages the other end of the workpiece, thereby capturing the workpiece between the grip elements 133 and 143 of respective units 130 and 140. The workpiece can then be raised/elevated away from the top frame 101 by the operation of pinion drive unit 150. In its raised position above the top frame 101, the workpiece may then be freely rotated via rotatable clamping pads 133 and 143 of units 130 and 140, respectively, for an assembly/installation operation.

Figure 2:
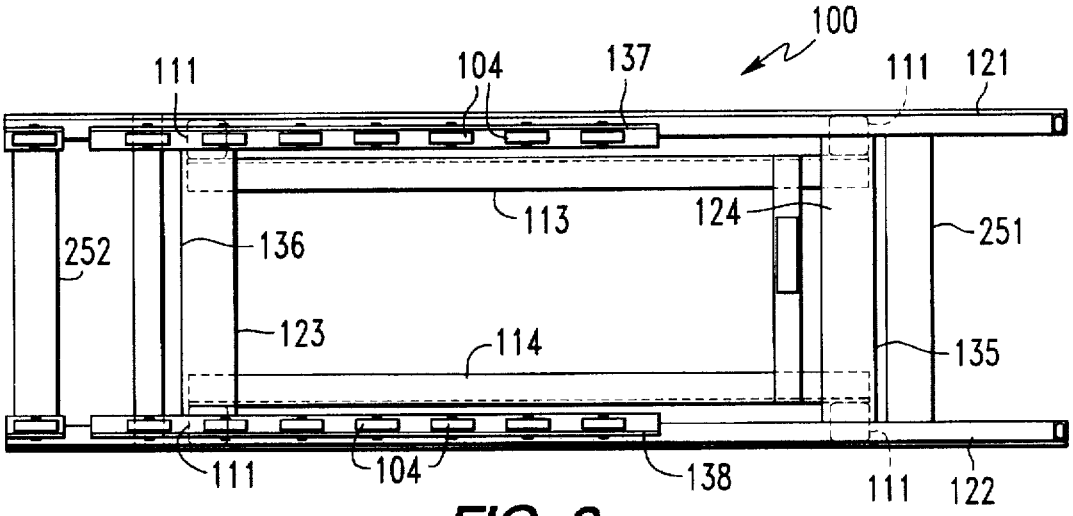
FIGS. 2, 3 and 4 are respective top, side and end views of the table 100 of the apparatus of FIG. 1.
Figure 3:
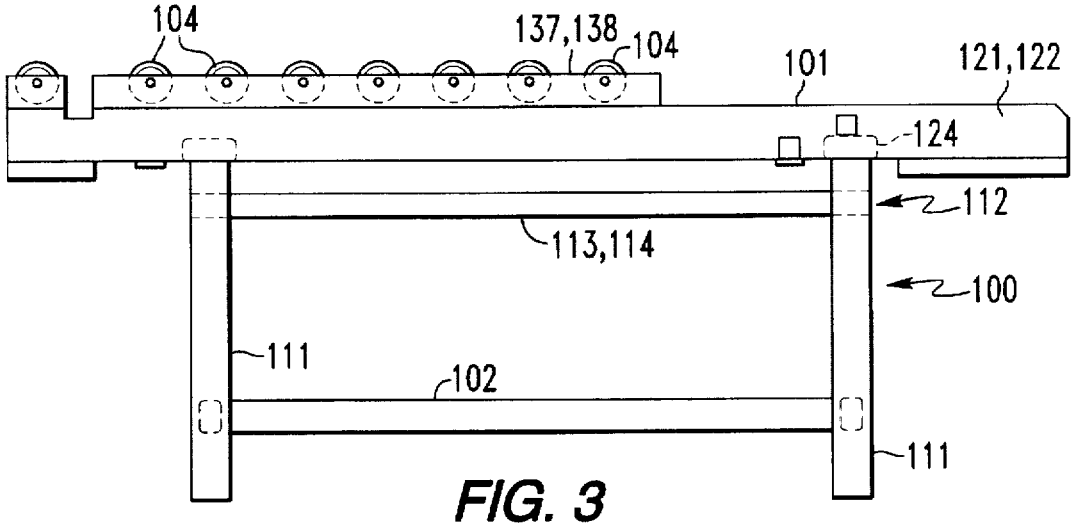
Figure 4:
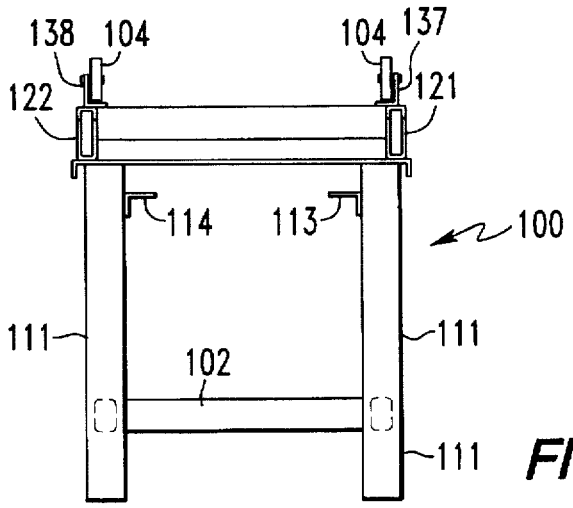

Referring now to FIGS. 2–4, the configuration of table 100 is shown in greater detail, wherein its longitudinally extending top frame 101 includes a pair of longitudinal side bars 121 and 122, and a pair of cross pieces 123 and 124, which are affixed (e.g. welded) to the side bars, and to which upper ends of the legs 111 are attached. The side bars 121 and 122 of top frame 101 extend beyond a first end 135 of the table 100, so as to allow for installation of elevator and rotation unit 130 adjacent to cross piece 124 and tilt frame 160. Side bars 121 and 122 also extend beyond a second end 136 of the table 100, where elevator and rotation unit 140 is installed.

Side bars 121 and 122 have respective side rails 137 and 138 mounted thereon, which extend a prescribed distance from their respective ends toward the first end 135 of the table. Side rails 137 and 138 are fitted with rollers 104, to provide a transport surface along which workpiece (door) 119 may easily travel, as described above, so that it may be readily picked up by rollers 106 of the tilt frame 160. Disposed beneath longitudinal side bars 121 and 122 of the top frame 101 are respective longitudinally extending L-shaped bracket members 113 and 114 of support platform 112, upon which the components of the elevation drive unit 150 and the lift frame position control mechanism 120 for lift frame 110 are mounted, as will be described.

Figure 5:
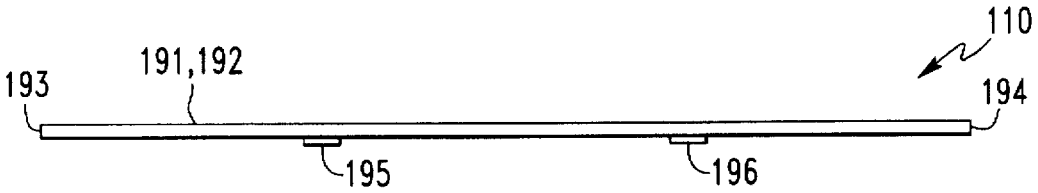
FIGS. 5 and 6 are respective side and top views of the lift frame 110 of the apparatus of FIG. 1.
Figure 6:
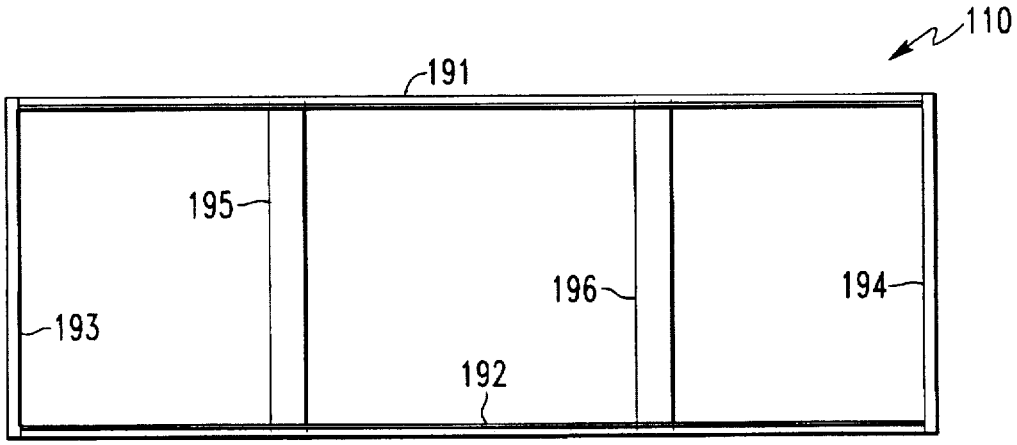

As shown in detail in FIGS. 5 and 6, lift frame 110 is generally rectangularly shaped, being comprised of a pair of L-shaped side spars 191 and 192, a pair of L-shaped end spars 193 and 194 and a pair of cross pieces 195 and 196. Lift frame 110 is sized to accommodate and support a portion of a door assembly, such as a window frame or the like, shown in broken lines 117 in FIG. 1, referenced above, which is to be mounted into opening 118 provided for the purpose in door structure 119, proper. The lift frame 110 is supported for controlled vertical movement within the table 100 by the lift frame position control mechanism 120, which is mounted on the pair of longitudinally extending L-shaped bracket members 113 and 114 of the detailed illustration of table 100 of FIGS. 2–4, described above.

Figure 7:
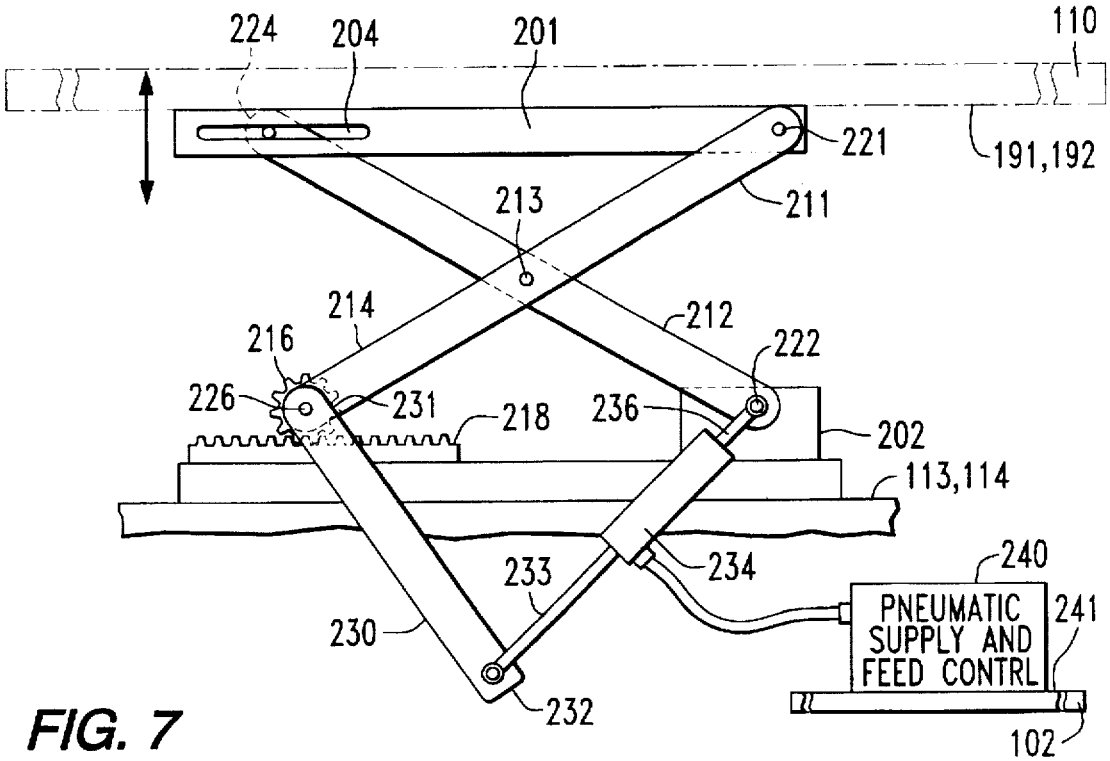
FIG. 7 diagrammatically illustrates the lift frame position control mechanism 120 of the apparatus of FIG. 1.

As diagrammatically illustrated in FIG. 7, lift frame position control mechanism 120 is configured as a scissors-configured lift mechanism and includes a pair of upper slide brackets 201, upon which the side spars 191 and 192 of the lift frame 110 are supported, and a pair of lower brackets 202 which are respectively mounted to the longitudinally extending L-shaped bracket members 113 and 114. A respective pair of scissors arms 211 and 212 is mounted between a respective upper slide bracket 201 and a respective lower bracket 202 on each side of the table. Scissor arm 211 is pivotally joined with scissor arm 212 at a pivot joint 213.

An upper end of scissor arm 211 is pivotally attached to upper bracket 201 at a pivot connection element 221. Similarly, a lower end of scissor arm 212 is pivotally attached to lower bracket 202 at a pivot connection element 222. An upper end 224 of scissor arm 212 is slidably attached to a horizontally extending slot 204 in upper bracket 201, the length of slot 204 and the lengths of the scissors and the length of the cylinder stroke defining the limits of vertical translation of the lift frame. A lower end 214 of scissor arm 211 is provided with a rotatable pinion gear 216, which engages and travels along a rack member 218 mounted to a respective one of longitudinally extending L-shaped bracket members 113 and 114.

Each of pinion gears 216 is mounted to opposite ends of a first shaft 226, which is solid with a first end 231 of a lever arm member 230. A second end 232 of lever arm member 230 is pivotally attached to a translatable shaft 233 of a drive cylinder 234 which is controlled by a pneumatic supply and feed control unit 240, mounted on a platform 241 supported by the table's lower frame 102. Although the drive cylinder and associated control supplies therefor of the apparatus of the present invention are described as pneumatic units, it is to be understood that the invention is not limited to such units, but may employ alternative equivalent types of units, such as hydraulic and electrical units, as non-limiting examples. In order to avoid unnecessary cluttering the drawings, the pneumatic supply sources and associated control elements therefor (e.g. foot treadle controls) have, for the most part, not been illustrated.

Drive cylinder 234 is affixed to a second shaft 236, opposite ends of which are coupled with pivot connection elements 222. By controlling the supply of pneumatic fluid to drive cylinder 234, its translatable shaft 233 will cause lever arm 230 to rotate, and thereby cause each pinion gear 216, which is solid with the end of lever arm 230, to travel along its associated rack 218, thus raising or lowering the upper slide bracket 201 (and the lift frame 110 supported thereby) of the scissors-configured lift mechanism, as the upper end 224 of each scissor arm 212 slides within its associated horizontally extending slot 204 in upper slide bracket 201.

Figure 8:
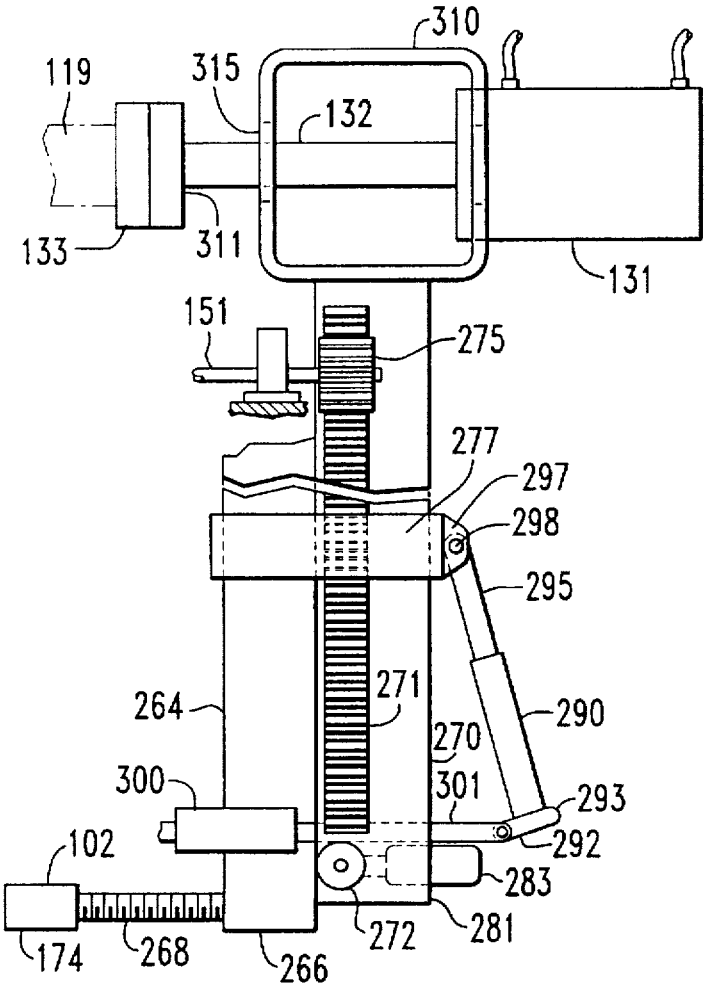
FIGS. 8 and 9 are respective diagrammatic side and end views of the elevator and rotation unit 130 of the apparatus of FIG. 1.
Figure 9:
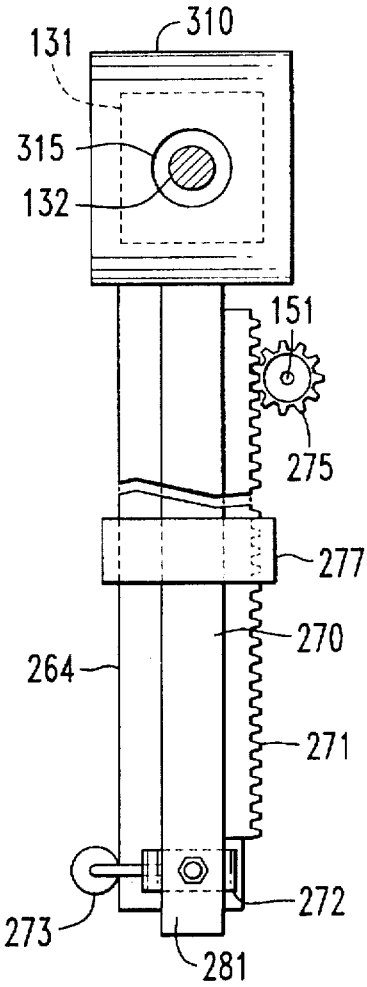

Referring now to FIGS. 8 and 9, elevator and rotation unit 130 is diagrammatically illustrated as comprising a vertically oriented guide post 264, an upper end of which is affixed to a cross bracket 251 which, as shown in FIG. 2, is supported between the side bars 121 and 122 of top frame 101 adjacent to the cross piece 124 at the first end 135 of the table 100. A lower end 266 of guide post 264 is joined to a cross piece 174 of lower frame 102 by means of an attachment bolt 268. A vertically translatable column member 270 having a rack 271 and a plurality of spatially orthogonal guide rollers 272, 273 is arranged to be vertically translatable along guide post 264 by the controlled rotational drive imparted by output shaft 151 of elevator drive unit 150 to a pinion 275, which engages the rack 271. Vertically translatable column member 270 is constrained to travel along guide post 264 by means of a guide bracket 277 and a guide roller at the upper end of the guide post 264, and the pair of spatially orthogonal guide rollers 272, 273 mounted to the lower end 281 of vertically translatable column member 270.

Projecting rearwardly from the lower end 281 of vertically translatable column member 270 is a horizontally extending stop element 283, which is arranged to be engaged by a bar element 292 at the lower end 293 of an outwardly pivotable bar 290. The length of pivotable bar member 290 may be adjusted to define the height above top frame 101 at which a grip element 133 becomes aligned with the end of a workpiece that has been placed upon the rollers 102 of the top frame, when stop element 283 engages bar element 292.

An upper end 295 of pivotable bar 290 is pivotally captured in a bracket 297, which is mounted to guide bracket 277. A pneumatic cylinder 300 is mounted to the lower frame 102 of table 100 and has a translatable output shaft 301 coupled with the lower end 293 of pivotable bar 290. By controlling the pneumatic supply to cylinder 300, the position of its output shaft 301 and thereby the separation between the lower end 281 of vertically translatable column member 270 (from which horizontally extending stop element 283 projects) and the lower end 293 of pivotable bar 290 can be controlled.

In the workpiece/door loading position, the pneumatic supply to cylinder 300 is controlled so as to draw shaft 301 into the cylinder 300, and thereby minimize the separation between the lower end 281 of vertically translatable column member 270 and the lower end 293 of pivotable bar 290. In this position, stop element 283 of vertically translatable column member 270 is engaged by bar element 292 at the lower end 293 of pivotable bar 290, so as to prevent upward movement of vertically translatable column member 270. As noted above, the length of pivotable bar 290 is adjustable to align grip/clamp pad element 133 of elevator and rotation unit 130 with the end of a workpiece/door that has been placed upon the rollers 102 of the top free, when stop element 283 engages bar element 292.

Once the door has been loaded or captured, the pneumatic supply to cylinder 300 is controlled so as to displace output shaft 301 away from the cylinder and increase the separation between the lower end 281 of vertically translatable column member 270 and the lower end 293 of pivotable bar 290, as bar 290 is pivoted about the axis 298 of bracket 297. The extension of the output shaft 301 of cylinder 300 is controlled such that the bar element 292 at the lower end 293 of pivotable bar 290 will not engage stop element 283, whereby stop element 283 is allowed to travel past bar element 292 and permit vertical movement of vertically translatable column member 270 by the rotation of pinion 275 against rack 271.

The upper end of vertically translatable column member 270 upon which rack 271 is mounted contains a generally rectangular tube-shaped fixture 310, to which a pneumatically driven cylinder of unit 130 is mounted. The rotatable output shaft 132 of unit 130 passes through a bore 315 in fixture 310 and has workpiece grip element 133 affixed to the end 311 of output shaft 132. Grip element 133 is sized to accommodate and engage an end face of door 119. Output shaft 132 is translatable in the longitudinal direction of the table and rotatable about its axis, so that a door may be seized by the respective grip elements at its opposite ends and, once seized, rotated for assembly.

Figure 10:
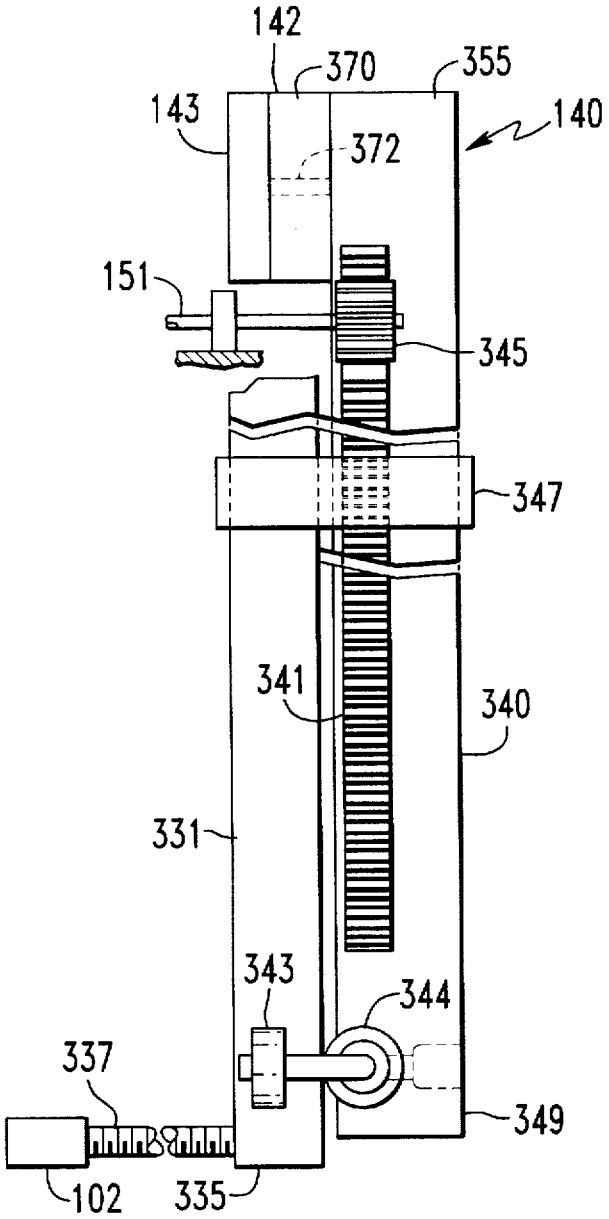
FIGS. 10 and 11 are respective diagrammatic side and end views of the elevator and rotation unit 140 of the apparatus of FIG. 1.
Figure 11:
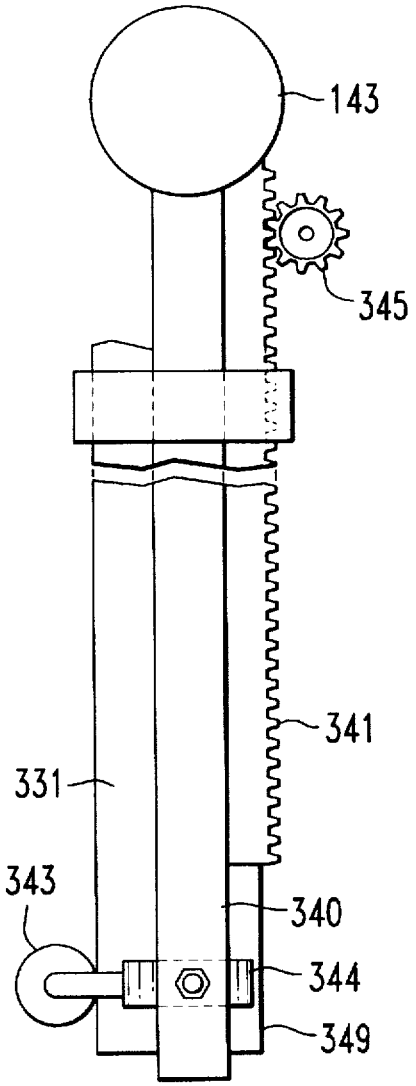

Referring now to FIGS. 10 and 11, elevator and rotation unit 140 is diagrammatically illustrated as comprising a vertically oriented guide post 331, an upper end of which is affixed to a cross bracket 252, which is supported between side bars 121 and 122 of top frame 101 adjacent to the cross piece 123 at the second end 136 of the table 100, as shown in FIG. 2. A lower end 335 of guide post 331 is joined to cross piece of lower frame 102 by means of an attachment bolt 337. A vertically translatable column member 340, having a rack 341 and a plurality of spatially orthogonal guide rollers 343 and 344, is vertically translatable along guide post 331 by the controlled rotational drive imparted by output shaft 151 of elevator drive unit 150 to a pinion 345, which engages the rack 341. Vertically translatable column member 340 is constrained to travel along guide post 331 by means of a bracket 347 and a guide roller at the upper end of the guide post 331, and the spatially orthogonal guide rollers 343 and 344 mounted to the lower end 349 of vertically translatable column member 340.

The rotational follower unit 141 of elevator and rotation unit 140 is mounted to a fixture 370 at an upper end 355 of vertically translatable column member 340. The output shaft 142 of rotational follower unit 141 is rotatable within a fixture bore 372 which is coaxial with the axis of the output shaft 132 of elevator and rotation unit 130 at the first end 135 of the table 100, described above.

Affixed to shaft 142 is clamp/grip pad element 143, which is sized to accommodate and engage an opposite end surface of the door 119. As noted earlier, the output shaft 142 of the elevator and rotation unit 140 at the second end 136 of the table 100 operates together with shaft 132 of the elevator and rotation unit 130 at the first end 135 of the table 100, to allow the door to be rotated as necessary for assembly in its raised position above the top frame.

Figure 12:
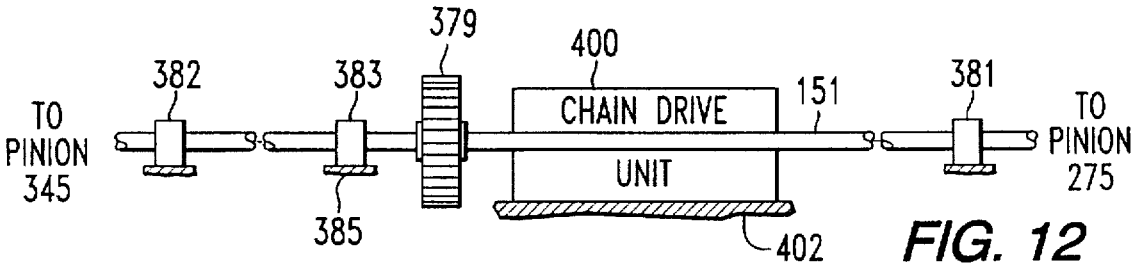
FIGS. 12 and 13 diagrammatically illustrate the elevator drive unit 150 for the drive pinions of the elevator and rotation units 130 and 140 of the apparatus of FIG. 1.
Figure 13:
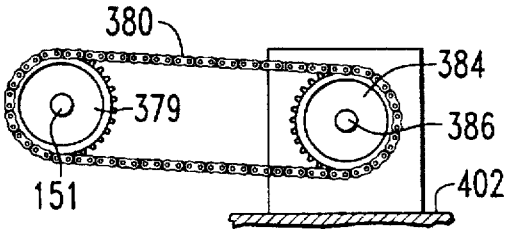

As shown in FIGS. 12 and 13, the elevator drive unit 150 for the pinions 275 and 345 of the elevator and rotation units 130 and 140, respectively, comprises a longitudinal drive shaft 151, which is supported in bearing units 381 and 382 at opposite ends of the table 100 adjacent to elevator and rotation units 130 and 140, and a bearing unit 383 mounted to a cross piece 385 which is joined to side bars 121 and 122. A sprocket element 379 is mounted solid with longitudinal drive shaft 151 and is arranged to engage a drive chain 380 which is driven by a drive chain drive gear 384 mounted to the output shaft 386 of a chain drive unit 400. Chain drive unit 400 is mounted to a plate 402 which is affixed to lower brackets 202 of the support platform 112.

Figure 14:
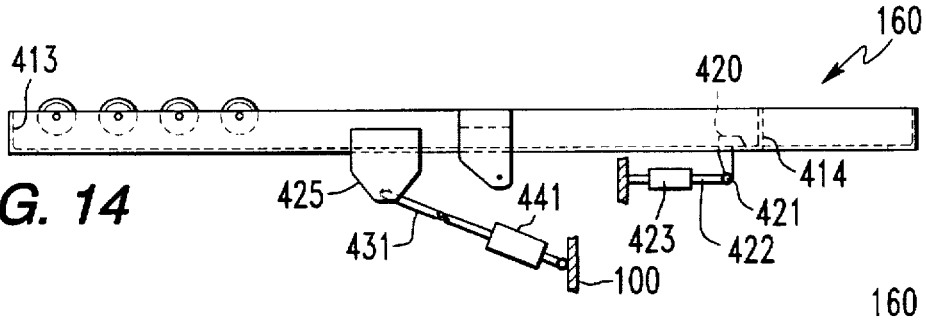
FIGS. 14 and 15 are respective diagrammatic side and top views of the tilt frame 160 of the apparatus of FIG. 1.
Figure 15:
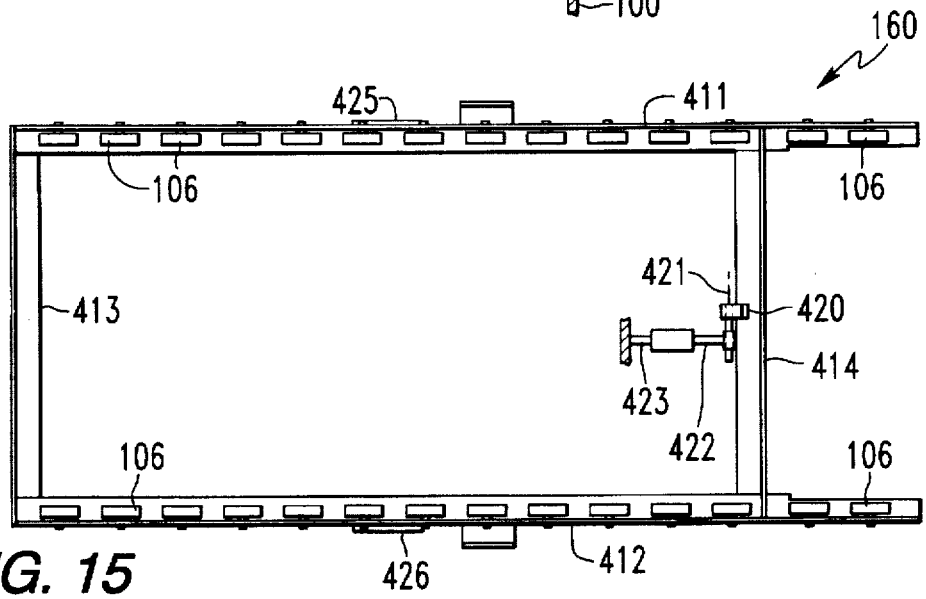

The tilt frame 160 is diagrammatically illustrated in FIGS. 14 and 15 as generally rectangularly shaped, being comprised of a pair of L-shaped side rail members 411 and 412 and a pair of L-shaped end rail members 413 and 414. The tilt frame 160 is supported upon the side bars 121 and 122 of the top frame 101 of the table 100, and is locked in its horizontal position or released therefrom by means of a rotatable hold down clamp member 420, which is controllably rotated about a pivot axis 421 by the output shaft 422 of an associated drive cylinder 423.

Rotatably mounted to the side rail members 411 and 412 of the tilt frame 160 are respective sets of the rollers 106, which provide a transport surface along which an assembled door 119 that has been released from the elevator and rotation units 130 and 140 may travel. The tilt frame 160 further includes a pair of brackets 425 and 426, attached to respective side rail members 411 and 412, and each of which engages an output shaft 431 of a respective pneumatic drive cylinder 441 affixed to the table 100.

When the output shafts 431 of the pneumatic drive cylinders 441 are extended, and the rotatable hold down clamp member 420 engages the tilt frame 160, the tilt frame 160 is maintained horizontal and parallel with the side rails 137 and 138 of the top frame 101, so that an assembled door may be readily rolled along the rollers 104 at the top of the table to be picked up by the rollers 106 of the tilt frame 160. When clamp member 420 is rotated away from its hold down position and the output shafts 431 of pneumatic drive cylinders 441 are withdrawn into the cylinders 441, the tilt frame 160 is rotated or tilted downwardly to a generally inclined position, as diagrammatically illustrated at 160A in FIG. 1, so as to facilitate removal of a assembled door from the table.

As will be appreciated from the foregoing description, the drawbacks of conventional door manufacturing schemes are effectively obviated by a new and improved multiple workpiece assembly apparatus, having a top frame and a controllably driven lift frame supported immediately beneath the top frame, and configured to support a first workpiece, such as a door insert, adjacent to the top frame for insertion into the main body of a door, that is seized by a pair of elevator and rotation units mounted adjacent to opposite ends of the top frame. Advantageously, the two elevator and rotation units provide for manipulation of the orientation of the second workpiece relative to the first workpiece as supported by the lift frame, so as to facilitate joining the first and second workpieces together into an assembled workpiece. Removal of the assembled workpiece from the table is facilitated by a controllably tiltable frame, which is arranged to receive the assembled workpiece from the top frame and controllably tilts the assembled workpiece away from the top frame.

While I have shown and described an embodiment in accordance with the present invention, it is to be understood that the same is not limited thereto but is susceptible to numerous changes and modifications as known to a person skilled in the art, and I therefore do not wish to be limited to the details shown and described herein but intend to cover all such changes and modifications as are obvious to one of ordinary skill in the art.

What is claimed:

1. A multiple workpiece assembly comprising:

a table having a top frame;

a lift frame supported by said table adjacent to said top frame and being configured to support a first workpiece thereon, said lift frame being controllably adjustable relative to said top frame; and a workpiece grasping and manipulation unit mounted with said table and being operative to grasp a second workpiece that has been placed upon said top frame and to provide for manipulation of the orientation of said second workpiece relative to said first workpiece supported by said lift frame, so as to enable said first and second workpieces to be joined together into an assembled workpiece, while being supported by said lift frame and said second workpiece capture unit.

2. A multiple workpiece assembly apparatus according to claim 1, further including an assembled workpiece release unit which is arranged with said top frame and is configured to transfer said assembled workpiece from said table.

3. A multiple workpiece assembly apparatus according to claim 2, wherein said assembled workpiece release unit comprises a controllably tiltable frame, which is supported by said table and is arranged to receive said assembled workpiece from said top frame and to controllably transfer said assembled workpiece away from said top frame for removal from said table.

4. A multiple workpiece assembly apparatus according to claim 1, wherein said workpiece grasping and manipulation unit comprises first and second grasping mechanisms configured to engage said second workpiece adjacent to first and second respective locations of said top frame, each of said first and second grasping mechanisms being operative to elevate said second workpiece above said first workpiece supported by said lift frame, and to provide for rotation of said second workpiece relative to said lift frame.

5. A multiple workpiece assembly apparatus according to claim 4, wherein said first and second grasping mechanisms are configured to engage opposite ends of said second workpiece that has been placed upon said top frame, and to controllably elevate said second workpiece above said first workpiece supported by said lift frame, and to provide for rotation of said second workpiece about an axis that is parallel to said lift frame.

6. A multiple workpiece assembly apparatus according to claim 1, wherein said first workpiece comprises an insert to a door and said second workpiece comprises a door having a frame region; and wherein said insert is joined with said frame region of said door.

7. A multiple workpiece assembly apparatus according to claim 2, wherein said top frame includes first and second side rails containing a set of roller elements upon which said second workpiece is translatable to said assembled workpiece release unit, and upon which said second workpiece is placed prior to being grasped by said workpiece grasping and manipulation mechanism.

8. A multiple workpiece assembly apparatus according to claim 7, wherein said assembled workpiece release unit comprises a controllably tiltable frame, which is supported by said table and has a plurality of roller elements arranged to receive said assembled workpiece translated thereto by way of said roller elements of said first and second rails of said top frame, and to controllably tilt said assembled workpiece away from said top frame for removal from said table.

9. A multiple workpiece assembly apparatus according to claim 1, wherein said first and second grasping mechanisms comprise rack and pinion driven elevator mechanisms, which are operative to controllably elevate said second workpiece above said first workpiece supported by said lift frame.

10. A multiple workpiece assembly apparatus according to claim 9, wherein said first grasping mechanism includes a first workpiece clamp unit coupled to a first of said rack and pinion elevator mechanisms, said first workpiece clamp unit be operative to engage a first end of said opposite ends of said second workpiece, and to provide for rotation of said second workpiece, and wherein said second grasping mechanism includes a second workpiece clamp unit coupled to a second of said rack and pinion elevator mechanisms, said second workpiece clamp unit being operative to engage a second end of said opposite ends of said second workpiece, and to provide for rotation of said second workpiece.

11. A multiple workpiece assembly apparatus according to claim 1, wherein said lift frame is supported by said table beneath said top frame so as to support said first workpiece beneath said top frame thereon, and is controllably adjustable to raise said first workpiece into engagement with said second workpiece that has been placed upon said top frame and grasped by said workpiece grasping and manipulation mechanism.

12. A multiple workpiece assembly apparatus according to claim 10, wherein said lift frame includes a lift frame position control mechanism mounted with said table and supporting said lift frame within said table.

13. A multiple workpiece assembly apparatus according to claim 12, wherein said lift frame position control mechanism comprises a scissors-configured lift mechanism.

14. A multiple workpiece assembly apparatus according to claim 12, wherein said workpiece grasping and manipulation unit comprises first and second grasping mechanisms configured to engage said second workpiece adjacent to first and second respective locations of said top frame, each of said first and second grasping mechanisms being operative to elevate said second workpiece above said first workpiece supported by said lift frame, and to provide for rotation of said second workpiece relative to said lift frame.

15. A multiple workpiece assembly apparatus according to claim 14, wherein said first and second grasping mechanisms comprise first and second rack and pinion driven elevator mechanisms, which are operative to controllably elevate said second workpiece above said first workpiece supported by said lift frame, said first workpiece grasping mechanism including a first clamp unit which is coupled to a first of said rack and pinion elevator mechanisms, and is provided with a first rotatable grip element which engages a first end of said second workpiece, and is operative to provide for rotation of said second workpiece, and wherein said second grasping mechanism includes a second clamp unit which is coupled to a second of said rack and pinion elevator mechanisms, and is provided with a second rotatable grip element which engages a second end of said second workpiece, and is operative to provide for rotation of said second workpiece.

16. A multiple workpiece assembly apparatus according to claim 15, wherein said workpiece grasping and manipulation unit further includes a pinion drive unit having a drive shaft coupled to the pinions of each said first and second rack and pinion elevator mechanisms.

* * * * *